US011035379B2

(12) United States Patent
Kojima et al.

(10) Patent No.: US 11,035,379 B2
(45) Date of Patent: Jun. 15, 2021

(54) DOUBLE-SUCTION CENTRIFUGAL FAN

(71) Applicant: DAIKIN INDUSTRIES, LTD., Osaka (JP)

(72) Inventors: Azumi Kojima, Osaka (JP); Takashi Kashihara, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 82 days.

(21) Appl. No.: 16/485,027

(22) PCT Filed: Mar. 9, 2018

(86) PCT No.: PCT/JP2018/009299
§ 371 (c)(1),
(2) Date: Aug. 9, 2019

(87) PCT Pub. No.: WO2018/168707
PCT Pub. Date: Sep. 20, 2018

(65) Prior Publication Data

US 2020/0003227 A1 Jan. 2, 2020

(30) Foreign Application Priority Data

Mar. 14, 2017 (JP) ..... JP2017-049072

(51) Int. Cl.
*F04D 29/44* (2006.01)
*F04D 25/08* (2006.01)
*F04D 29/30* (2006.01)

(52) U.S. Cl.
CPC ..... *F04D 29/444* (2013.01); *F04D 25/08* (2013.01); *F04D 29/30* (2013.01); *F05D 2250/51* (2013.01)

(58) Field of Classification Search
CPC ..... F04D 29/444; F04D 29/30; F04D 25/08; F05D 2250/51
See application file for complete search history.

(56) References Cited

U.S. PATENT DOCUMENTS 9,929,331 B2 * 3/2018 Otey ..... H01L 35/30
9,995,303 B2 * 6/2018 Ikeda ..... F04D 29/681
(Continued)

FOREIGN PATENT DOCUMENTS

JP 49-63007 A 6/1974
JP S 4963007 A * 6/1974
(Continued)

OTHER PUBLICATIONS

JPS 4963007A English Translation (Year: 1974).*
(Continued)

*Primary Examiner* — Shafiq Mian
(74) *Attorney, Agent, or Firm* — Birch, Stewart, Kolasch & Birch, LLP

(57) ABSTRACT

A double-suction centrifugal fan includes: a first impeller coupled to a shaft; a second impeller provided with a second inlet port opened opposite to an electric motor and coupled to the shaft at a position farther from the electric motor than the first impeller; a first bell mouth connected to a first inlet port of the first impeller, and a second bell mouth connected to the second inlet port of the second impeller. An axial length L2 of the second bell mouth is greater than an axial length L1 of the first bell mouth.

4 Claims, 9 Drawing Sheets

(56) References Cited

U.S. PATENT DOCUMENTS

| | | | | |
|---|---|---|---|---|
| 2004/0018083 | A1* | 1/2004 | Sohn | F04D 29/422<br>415/119 |
| 2005/0163614 | A1* | 7/2005 | Chapman | F04D 29/281<br>415/206 |
| 2013/0101451 | A1* | 4/2013 | Dickinson | F04D 17/162<br>417/423.7 |
| 2016/0290345 | A1* | 10/2016 | Palomba | F04D 25/0606 |
| 2019/0170155 | A1* | 6/2019 | Pelton | F04D 29/286 |

FOREIGN PATENT DOCUMENTS

| | | | |
|---|---|---|---|
| JP | 2011-80368 | A | 4/2011 |
| JP | 2016-31059 | A | 3/2016 |
| JP | 2016-65715 | A | 4/2016 |

OTHER PUBLICATIONS

International Search Report issued PCT/JP2018/009299 (PCT/ISA/210), dated May 29, 2018.

Mu Wei-ming, "Energy Saving Techniques for Pumps and Fans," pp. 74-11 (d), Shanghai Jiao Tong University Press, Aug. 2013, with a partial English translation.

* cited by examiner

FIG.11

| | NO.1 | NO.2 | NO.3 | NO.4 | NO.5 | NO.6 |
|---|---|---|---|---|---|---|
| LENGTH L1 OF FIRST BELL MOUTH (CLOSE TO MOTOR) | REFERENCE (61m) | +40mm (101mm) | +40mm (101mm) | +20mm (81mm) | REFERENCE (61mm) | REFERENCE (61mm) |
| LENGTH L2 OF SECOND BELL MOUTH (FAR FROM MOTOR) | REFERENCE (61m) | +40mm (101mm) | +20mm (81mm) | +40mm (101mm) | +40mm (101mm) | +40mm (101mm) |
| LAP LENGTHS W1 AND W2 OF FIRST AND SECOND BELL MOUTHS | REFERENCE (5mm) | REFERENCE (5mm) | REFERENCE (5mm) | REFERENCE (5mm) | REFERENCE (5mm) | +5mm (10mm) |
| IMPROVEMENT IN FAN EFFICIENCY | REFERENCE | ±0% | −2% | +2% | +2% | +3% |

DOUBLE-SUCTION CENTRIFUGAL FAN

TECHNICAL FIELD

The present invention relates to a double-suction centrifugal fan.

BACKGROUND ART

A double-suction centrifugal fan has been known as a centrifugal fan transporting the air. Patent Document 1 discloses a double-suction centrifugal fan of this type.

As shown in FIG. 4 of Patent Document 1, for example, a double-suction centrifugal fan includes two impellers coupled to a shaft of an electric motor. One of the impellers has an inlet port opened toward the electric motor, and the other impeller has an inlet port opened opposite to the electric motor. A bell mouth for guiding the air is connected to each of the inlet ports of the impellers. When the shaft of the electric motor is driven, the two impellers are rotated. Then, the air is sucked into the inlet ports of the impellers via the bell mouths. The air sucked into each inlet port changes its direction to the outside in the radial direction of the impeller, and flows out from an outlet port.

CITATION LIST

Patent Document

[Patent Document 1] Japanese Unexamined Patent Publication No. 2016-65715

SUMMARY OF THE INVENTION

Technical Problem

The bell mouths described above have the function of rectifying the air within the bell mouths, thereby improving the fan efficiency of the centrifugal fan. In the double-suction centrifugal fan, air inflow ports of the bell mouths face opposite directions, and one of the bell mouths is arranged to suck the air around the electric motor. The inventors of the present invention have focused on the layout peculiar to the double-suction centrifugal fan, and have made a study on the improvement in the fan efficiency.

In view of the foregoing, the present invention has been achieved to improve fan efficiency of a double-suction centrifugal fan including bell mouths respectively attached to impellers.

Solution to the Problem

A first aspect of the present invention is directed to a double-suction centrifugal fan, including: an electric motor (31) having a shaft (33); a first impeller (40) provided with a first inlet port (44) opened toward the electric motor (31), and coupled to the shaft (33); a second impeller (50) provided with a second inlet port (54) opened opposite to the electric motor (31), and coupled to the shaft (33) at a position farther from the electric motor (31) than the first impeller (40); a first bell mouth (60) connected to a first inlet port (44) of the first impeller (40), and a second bell mouth (70) connected to a second inlet port (54) of the second impeller (50), wherein an axial length L2 of the second bell mouth (70) is greater than an axial length L1 of the first bell mouth (60).

In the first aspect, the axial length L2 of the second bell mouth (70) of the second impeller (50) farther from the electric motor (31) is greater than the axial length L1 of the first bell mouth (60) of the first impeller (40) close to the electric motor (31). This configuration improves the fan efficiency of the double-suction centrifugal fan. The inventors have experimentally found this issue. A presumable reason why the fan efficiency improves is described below.

The first bell mouth (60) has an air inflow port (66) formed near the electric motor (31). Thus, if the axial length L1 of the first bell mouth (60) is too great, the distance between the electric motor (31) and the air inflow port (66) decreases too much, and the air hardly flows into the first bell mouth (60). That is, the air flow resistance increases at the inflow side of the first bell mouth (60). For this reason, the axial length L1 of the first bell mouth (60) is preferably smaller than the axial length L2 of the second bell mouth (70).

On the other hand, the second bell mouth (70) has an air inflow port (76) facing opposite to the electric motor (31). Thus, even if the axial length L2 of the second bell mouth (70) is increased, the second bell mouth (70) does not interfere with the electric motor (31). Increasing the axial length L2 of the second bell mouth (70) causes the second bell mouth to rectify the air more effectively. Therefore, the axial length L2 of the second bell mouth (70) is preferably greater than the axial length L1 of the first bell mouth (60).

For the above reason, making the axial length L2 of the second bell mouth (70) greater than the axial length L1 of the first bell mouth (60) is presumed to improve the fan efficiency.

A second aspect of the present invention is an embodiment of the first aspect. In the second aspect, each of the first bell mouth (60) and the second bell mouth (70) has a tubular straight portion (62, 72) extending along an axis thereof, and a length Ls2 of the straight portion (72) of the second bell mouth (70) is greater than a length Ls1 of the straight portion (62) of the first bell mouth (60).

The lengths Ls1 and Ls2 of the straight portions (62, 72) of the bell mouths (60, 70) greatly contribute to the effective rectification by the bell mouths (60, 70). Therefore, making the length Ls2 of the second straight portion (72) of the second bell mouth (70) greater than the length Ls2 of the first straight portion (62) of the first bell mouth (60) allows the second bell mouth (70) to rectify the air more effectively. Even if the length Ls2 of the second straight portion (72) of the second bell mouth (70) is increased, the second bell mouth (70) does not interfere with the electric motor (31).

A third aspect of the present invention is an embodiment of the first or second aspect. In the third aspect, an inner diameter d2 of an air inflow port (76) of the second bell mouth (70) is greater than an inner diameter d1 of an air inflow port (66) of the first bell mouth (60).

In the third aspect of the invention, the inner diameter d2 of the air inflow port (76) of the second bell mouth (70) is made greater than the inner diameter d1 of the air inflow port (66) of the first bell mouth (60), so that the air around the second bell mouth (70) is easily collected into the second bell mouth (70).

Advantages of the Invention

According to the present invention, the axial length L2 of the second bell mouth (70) farther from the electric motor (31) is made greater than the axial length L1 of the first bell mouth (60) closer to the electric motor (31). This allows the bell mouths (60, 70) to effectively exhibit their function, and can further improve the fan efficiency.

BRIEF DESCRIPTION OF THE DRAWINGS

FIG. 11 is a table showing the results of verification of the relationship between dimensions of bell mouths and a fan efficiency improvement rate.

DESCRIPTION OF EMBODIMENTS

Embodiments of the present invention will be described in detail with reference to the drawings. The embodiments below are merely exemplary ones in nature, and are not intended to limit the scope, applications, or use of the present invention.

A double-suction centrifugal fan (30) of the present invention is mounted on an air conditioner (10) which conditions the air in a target space.

<General Configuration of Air Conditioner>

Figure 1:
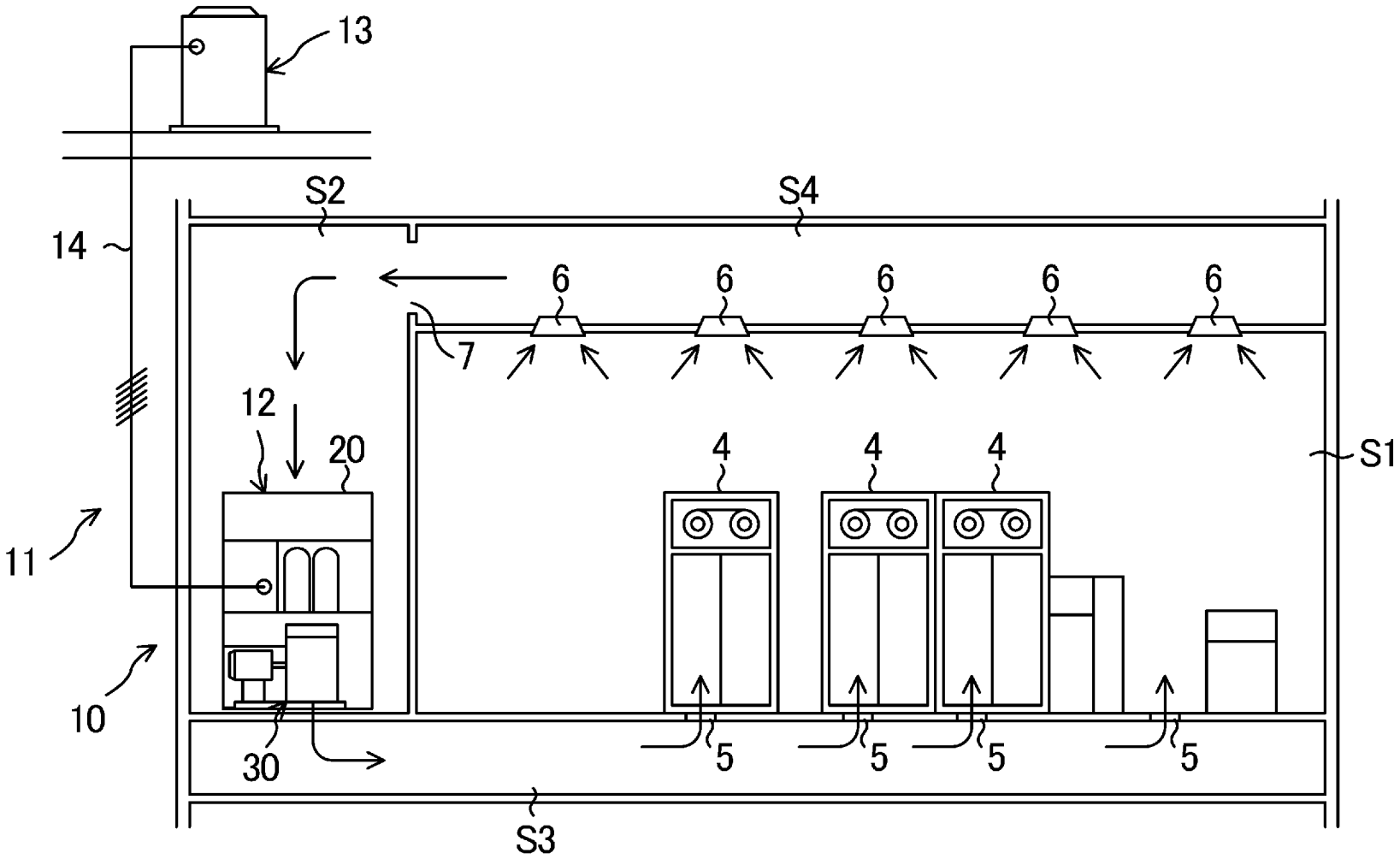
FIG. 1 is a schematic configuration diagram of an air conditioner according to an embodiment.

As shown in FIG. 1, the air conditioner (10) conditions the air in a computer room (S1), for example. The air conditioner (10) includes a refrigerant circuit (11) filled with a refrigerant. The refrigerant circuit (11) allows the refrigerant to circulate therein, thereby performing a vapor compression refrigeration cycle. The air conditioner (10) includes an indoor unit (12), an outdoor unit (13), and a refrigerant pipe (14) connecting the indoor and outdoor units. The outdoor unit (13) is installed outdoors (for example, on a rooftop), and the indoor unit (12) is installed indoors.

<General Configuration of Indoor Space>

As shown in FIG. 1, a computer room (S1), an air conditioner room (S2), an underfloor space (S3), and a ceiling space (S4) are defined in an indoor space. Computers (4) are installed in the computer room (S1), and the indoor unit (12) is installed in the air conditioner room (S2). The air conditioner room (S2) communicates with the underfloor space (S3) through a communication port (not shown) formed in the floor of the air conditioner room (S2). The underfloor space (S3) communicates with the computer room (S1) through a plurality of air supply ports (5) formed in the floor of the computer room (S1). The computer room (S1) communicates with the ceiling space (S4) through a plurality of exhaust ports (6) formed in the ceiling. The ceiling space (S4) communicates with the air conditioner room (S2) through a communication port (7). In this way, the air conditioner room (S2) and the computer room (S1) in the indoor space communicate with each other to form a circulation flow path in which the air circulates.

<Indoor Unit>

Figure 2:
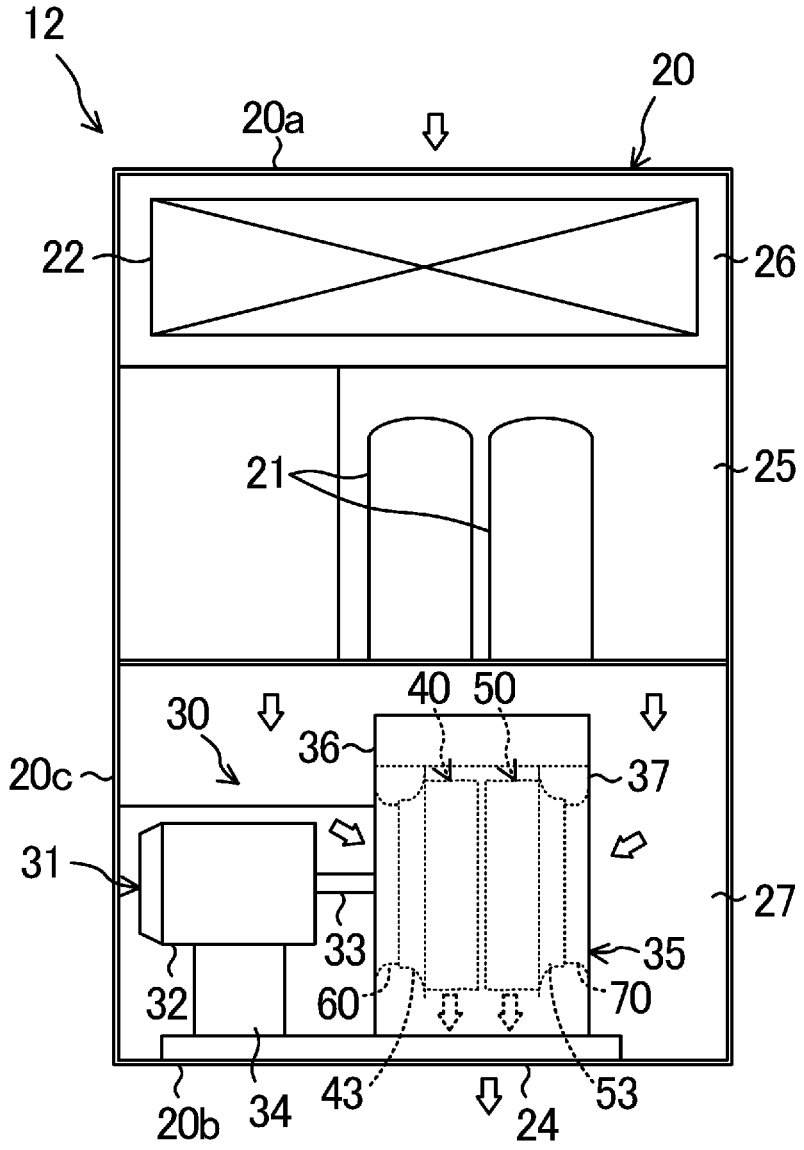
FIG. 2 is a schematic front view illustrating an internal structure of an indoor unit according to an embodiment.
Figure 3:
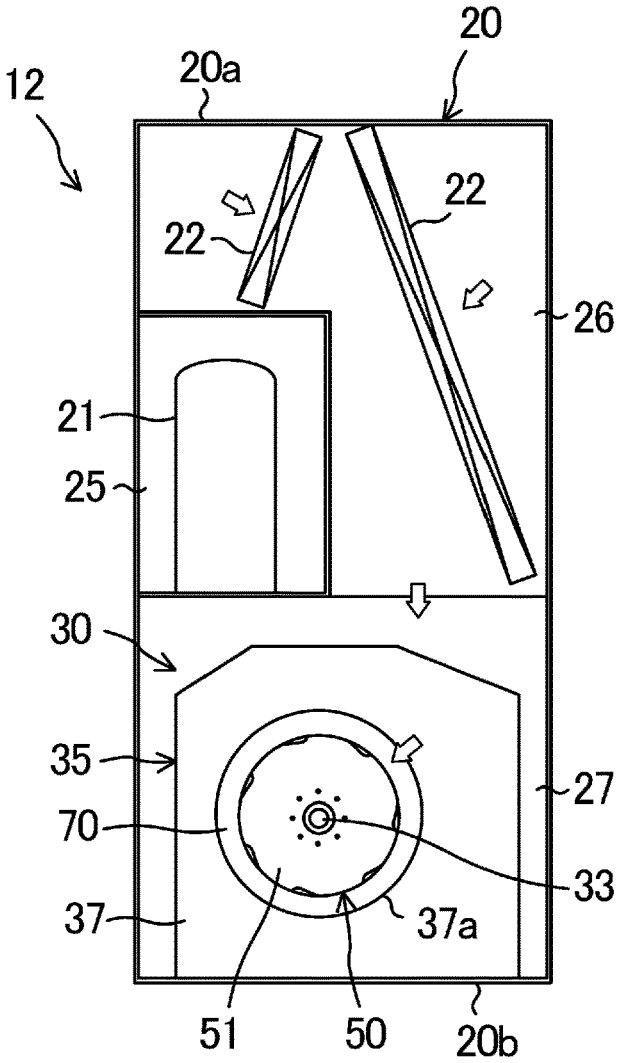
FIG. 3 is a schematic side view illustrating an internal structure of an indoor unit according to an embodiment.
Figure 4:
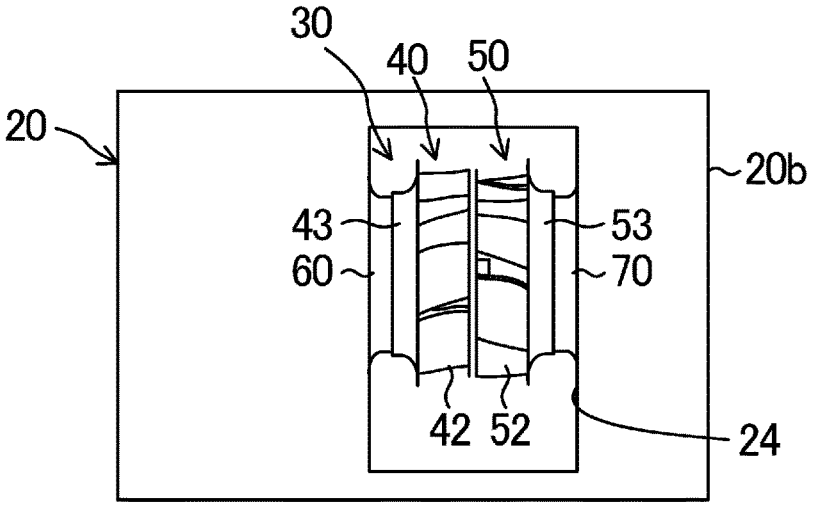
FIG. 4 is a bottom view of an indoor unit according to an embodiment.

As shown in FIGS. 2 to 4, the indoor unit (12) includes a casing (20), in which a compressor (21), an indoor heat exchanger (22), and a double-suction centrifugal fan (30) (will be hereinafter sometimes referred to as a "fan (30)") are housed.

The casing (20) is formed in a vertically long rectangular box shape. A case-side inlet port (not shown) is formed through a top plate (20*a*) of the casing (20), and an outlet port (24) is formed through a bottom plate (20*b*) of the casing (20) (see FIG. 4). An upper space inside the casing (20) is divided into a compressor chamber (25) and a heat exchanger chamber (26). The compressor (21), an accumulator (not shown), and other suitable components are installed in the compressor chamber (25), and the fin-and-tube indoor heat exchanger (22) is installed in the heat exchanger chamber (26). A lower space inside the casing (20) constitutes a fan chamber (27). The fan (30) is installed in the fan chamber (27). The case-side inlet port, the heat exchanger chamber (26), the fan chamber (27), and the outlet port (24) communicate in this order, thereby forming an air flow path in the casing (20).

<Double-Suction Centrifugal Fan>

The configuration of the fan (30) will be described in detail with reference to FIGS. 2 to 10.

The fan (30) is installed in the fan chamber (27). The fan (30) includes an electric motor (31), a fan case (35), a first fan rotor (40) (first impeller), a second fan rotor (50) (second impeller), a coupling member (80), a first bell mouth (60), and a second bell mouth (70).

<Electric Motor>

As shown in FIG. 2, the electric motor (31) is disposed near one of side plates (20*c*) of the casing (20). The electric motor (31) includes a motor body (32), and a shaft (33) which is driven in rotation by the motor body (32). The motor body (32) is supported by a motor support (34) provided on the bottom plate (20*b*) of the casing (20). The shaft (33) extends horizontally along the bottom plate (20*b*) of the casing (20).

<Fan Case>

Figure 5:
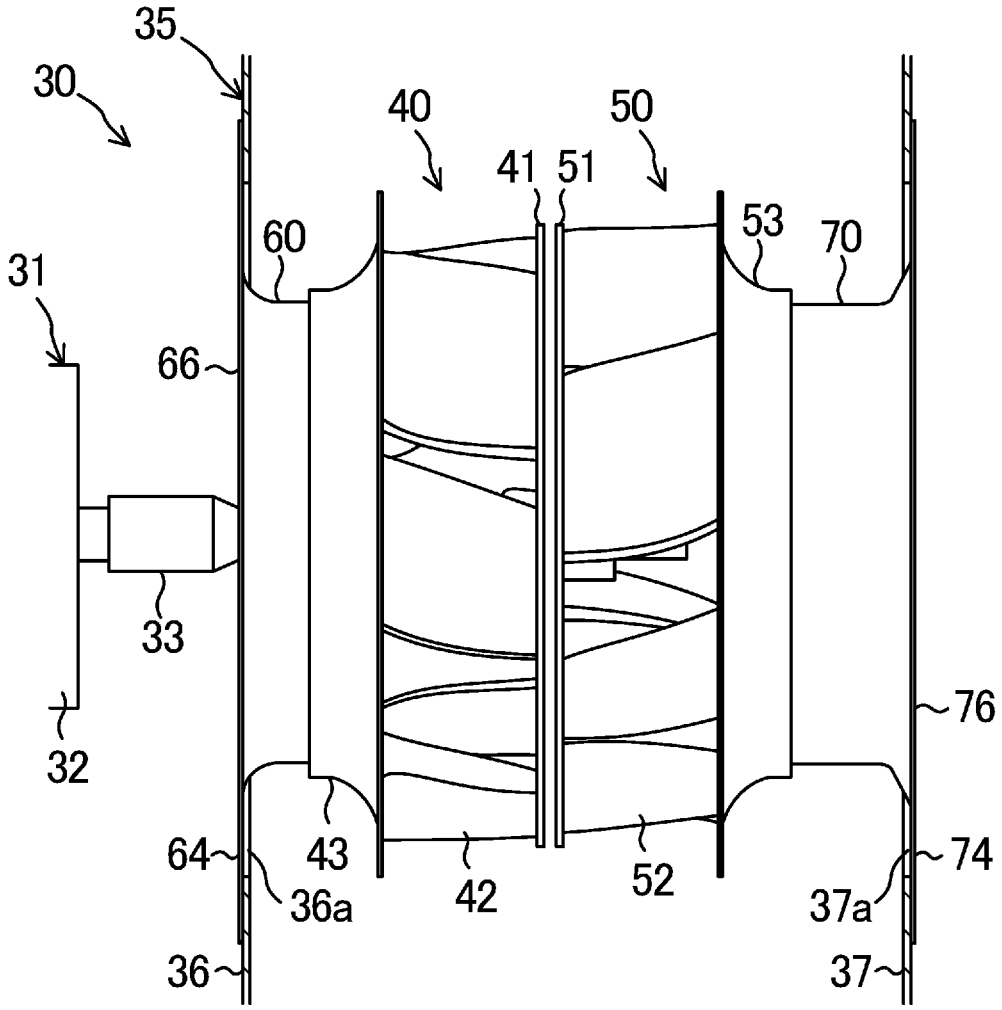
FIG. 5 is an enlarged side view illustrating a major part of a fan according to an embodiment.

The fan case (35) is in the shape of a box with an open bottom, and is placed on the bottom plate (20*b*) of the casing (20). The bottom opening of the fan case (35) communicates with the outlet port (24) of the bottom plate (20*b*). As shown in FIG. 5, the fan case (35) includes a first side plate (36) near the electric motor (31), and a second side plate (37) located across the first side plate (36) from the electric motor (31). The first and second side plates (36, 37) stand upright in a vertical direction. The first side plate (36) is provided with a first circular opening (36*a*), and the second side plate (37) is provided with a second circular opening (37*a*). The first bell mouth (60) is inserted in the first circular opening (36*a*). An outer edge of the first bell mouth (60) is fixed to the first side plate (36). The second bell mouth (70) is inserted in the second circular opening (37*a*). An outer edge of the second bell mouth (70) is fixed to the second side plate (37).

<Fan Rotor>

The first and second fan rotors (40, 50) are coupled to the shaft (33). Strictly speaking, the first and second fan rotors (40, 50) are coupled to the shaft (33) via the coupling member (80) (see FIG. 6). The first and second fan rotors (40, 50) are sequentially arranged on the shaft (33) in a direction away from the electric motor (31). That is, the first fan rotor (40) constitutes a first impeller closer to the electric motor (31), and the second fan rotor (50) constitutes a second impeller farther from the electric motor (31) than the first fan rotor (40).

The first and second fan rotors (40, 50) are basically comprised of the same components. Specifically, the first fan rotor (40) includes a first end plate (41), a plurality of blades (42), and a first shroud (43), while the second fan rotor (50) includes a second end plate (51), a plurality of blades (52), and a second shroud (53). The first and second fan rotors (40, 50) are configured or shaped to be in mirror symmetry when they are coupled to the shaft (33).

The first and second fan rotors (40, 50) are arranged so that their end plates (41, 51) are adjacent to each other in their axial direction. The first fan rotor (40) is configured to suck the air coming from the side near the electric motor (31) (the left side in FIG. 6), and transport the air outward in the radial direction. The second fan rotor (50) is configured to suck the air coming from the side opposite to the electric motor (31) (the right side in FIG. 6), and transport the air outward in the radial direction.

<End Plate>

Figure 6:
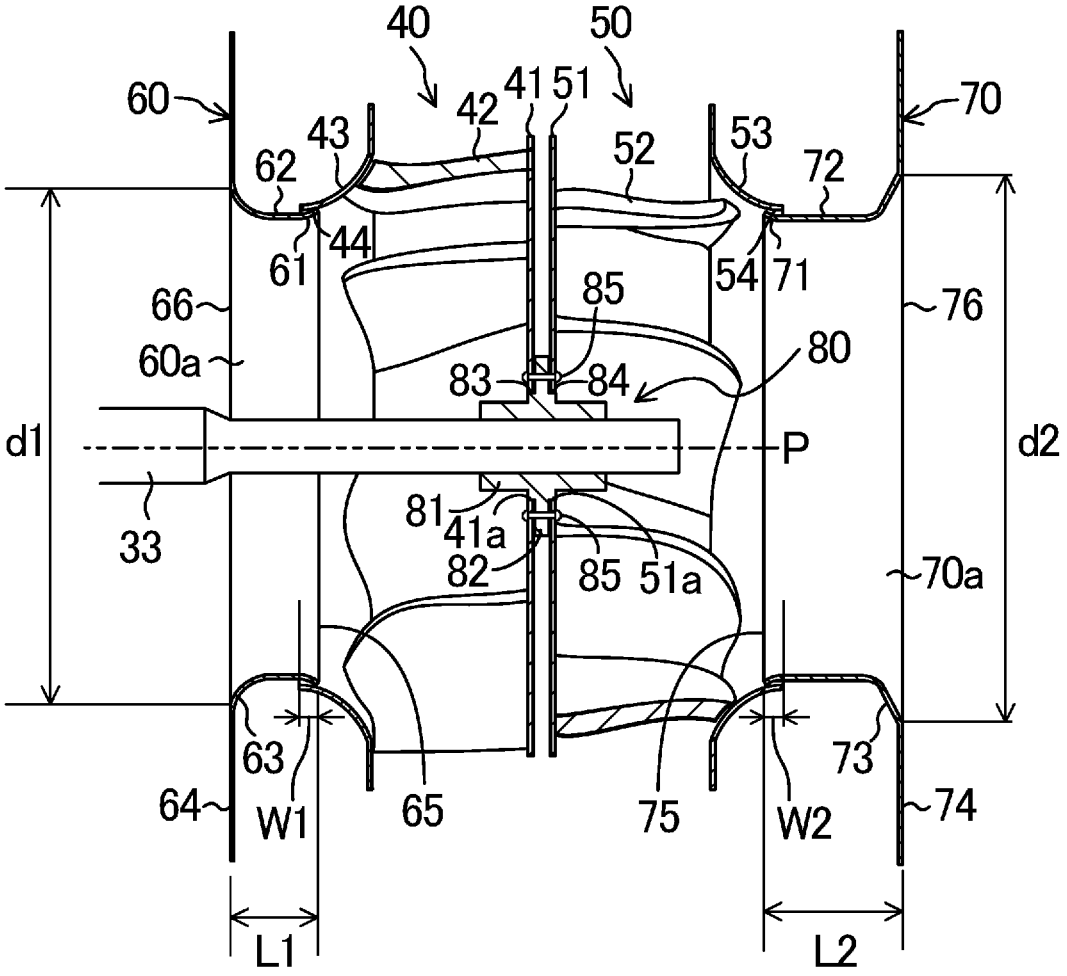
FIG. 6 is a longitudinal sectional view illustrating a major part of a fan according to an embodiment.

Each of the first and second end plates (41, 51) is formed of a substantially disk-shaped steel plate. A first through hole (41*a*) is formed in the first end plate (41), and a second through hole (51*a*) is formed in the second end plate (51). The shaft (33) penetrates the first and second through holes (41*a*, 51*a*). As shown in FIG. 6, the first and second end plates (41, 51) are fixed to the coupling member (80) which is interposed therebetween.

<Blades>

Figure 7:
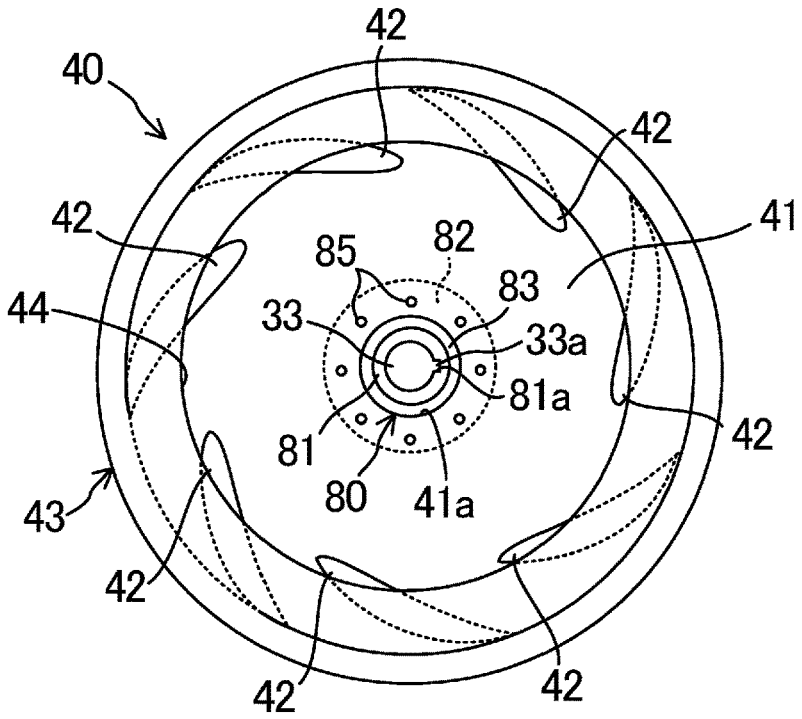
FIG. 7 is a front view of a first fan rotor according to an embodiment.
Figure 8:
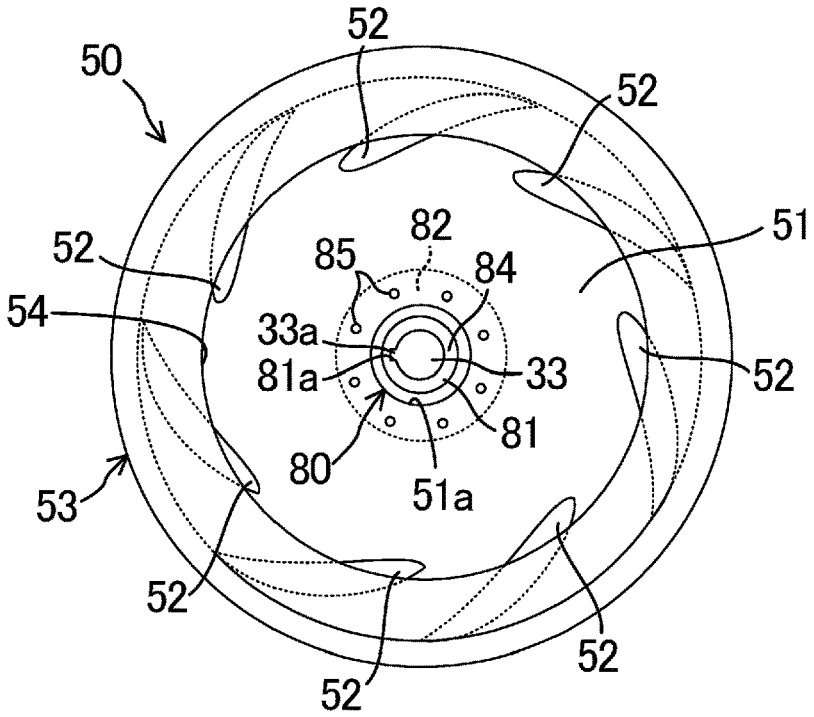
FIG. 8 is a front view of a second fan rotor according to an embodiment.

As shown in FIGS. 6 and 7, a base portion of each of the plurality of blades (42) of the first fan rotor (40) is welded to a surface of the first end plate (41) (a surface facing the electric motor (31)). As shown in FIGS. 6 and 8, a base portion of each of the plurality of blades (52) of the second fan rotor (50) is welded to a surface of the second end plate (51) (a surface facing opposite to the electric motor (31)). As described above, the blades (42) of the first fan rotor (40) and the blades (52) of the second fan rotor (50) are configured or shaped to be in reflective symmetry, with two end plates (41, 51) interposed therebetween.

Each of the blades (42, 52) of the first and second fan rotors (40, 50) has a complicated shape, i.e., has a thickness that varies unevenly from a base end to tip end thereof. Furthermore, the blades (42, 52) of the first and second fan rotors (40, 50) are arranged at an uneven pitch in the circumferential direction, i.e., a so-called irregular pitch. In this embodiment, the first fan rotor (40) has seven blades (42), and the second fan rotor (50) has seven blades (52). This is merely an example, and the number of the blades may be six or less, or eight or more.

<Shroud>

Each of the first and second shrouds (43, 53) is formed in a substantially cylindrical shape which is flat in the axial direction. The first shroud (43) is substantially in the shape of a truncated cone, or tapered, i.e., has an inner diameter decreasing toward the suction side (toward the electric motor (31)). The second shroud (53) is substantially in the shape of a truncated cone, or tapered, i.e., has an inner diameter decreasing toward the suction side (toward the side opposite to the electric motor (31)). A first inlet port (44) for sucking the air is formed at a distal end (left end in FIG. 6) of the first shroud (43). A second inlet port (54) for sucking the air is formed at a distal end (right end in FIG. 6) of the second shroud (53). The first and second inlet ports (44, 54) are circular openings. The first inlet port (44) is connected to a terminal end of the first bell mouth (60), and the second inlet port (54) is connected to a terminal end of the second bell mouth (70).

<Bell Mouth>

Each of the first and second bell mouths (60, 70) is formed in a substantially tubular shape which is flat in the axial direction. A first flow path (60*a*) for rectifying the air is formed inside the first bell mouth (60). A second flow path (70*a*) for rectifying the air is formed inside the second bell mouth (70).

The first bell mouth (60) includes a first connecting portion (61), a first straight portion (62), a first flared portion (63), and a first flange portion (64) which are continuous from the first inlet port (44) of the first shroud (43) toward the electric motor (31). The second bell mouth (70) includes a second connecting portion (71), a second straight portion (72), a second flared portion (73), and a second flange portion (74) which are continuous from the second inlet port (54) of the second shroud (53) toward the side opposite to the electric motor (31).

The first connecting portion (61) is a cylindrical portion that fits in the first inlet port (44) of the first shroud (43). The second connecting portion (71) is a cylindrical portion that fits in the second inlet port (54) of the second shroud (53). The first connecting portion (61) forms therein a first outflow port (65) through which the air in the first bell mouth (60) flows out, and the second connecting portion (71) forms therein a second outflow port (75) through which the air in the second bell mouth (70) flows out. Each of the connecting portions (61, 71) is formed in an inverted tapered shape in which the inner diameter gradually increases in a direction of the air flowing outward.

The first flange portion (64) is formed in a disk shape, and is disposed near the electric motor (31). The first flange portion (64) forms therein a first circular inflow port (66) through which the air is taken into the first bell mouth (60). An outer edge portion of the first flange portion (64) is fixed to the first side plate (36) of the fan case (35). The second flange portion (74) is formed in a disk shape, and is disposed on the side opposite to the electric motor (31). The second flange portion (74) forms therein a second circular inflow port (76) through which the air is taken into the second bell mouth (70). An outer edge portion of the second flange portion (74) is fixed to the second side plate (37) of the fan case (35).

Each of the first and second straight portions (62, 72) is a perfect round tubular portion extending along the axis of the corresponding bell mouth (60, 70). That is, the peripheral wall or inner peripheral surface of each of the first and second straight portions (62, 72) is formed parallel to the axis (corresponding to the axis (P) of the shaft (33) shown in FIG. 6) of the corresponding bell mouth (60, 70) across both ends thereof in the axial direction. The first and second straight portions (62, 72) particularly contribute to the rectification of the air flowing inside the bell mouths (60, 70).

The first flared portion (63) is a tubular portion formed between the first flange portion (64) and the first straight portion (62). The second flared portion (73) is a tubular portion formed between the second flange portion (74) and the second straight portion (72). Each of the first and second flared portions (63, 73) is formed in an inverted tapered shape in which the inner diameter gradually increases toward the side from which the air flows into the corresponding bell mouth.

More specifically, the second flared portion (73) is in the shape of a truncated cone which extends linearly when viewed in a longitudinal section. The first flared portion (63) extends in an arc shape like a trumpet when viewed in a longitudinal section. Note that both of the first and second flared portions (63, 73) may extend linearly, or in an arc shape.

[Coupling Member]

The coupling member (80) includes a tubular boss (81), and a disk-shaped flange (82) protruding radially outward from a middle portion in the axial direction of the boss (81). The boss (81) has a key groove (81*a*) formed in an inner peripheral surface thereof, into which a key (33*a*) of the shaft (33) fits (see FIGS. 7 and 8). A first annular step (83) and a second annular step (84) are formed in a base portion of the flange (82). The first step (83) is formed near the first fan rotor (40) in the base portion of the flange (82). The first step (83) is fitted in the first through hole (41*a*) of the first end plate (41). The second step (84) is fitted in the second through hole (51*a*) of the second end plate (51). In this state, the first end plate (41), the second end plate (51), and the flange (82) of the coupling member (80) are integrally fixed together with a plurality of rivets (85) (fixing members). Thus, the first and second end plates (41, 51) are coupled to the shaft (33) to be perpendicular to the shaft (33). A plurality of bolts and nuts may replace the plurality of rivets (85) as the fixing members.

—Operation of Air Conditioner—

When the air conditioner (10) is operated, the compressor (21), a fan (not shown) of the outdoor unit (13), and the fan (30) of the indoor unit (12) are in operation. Thus, the refrigerant circuit (11) performs a refrigeration cycle in which, for example, the refrigerant dissipates heat or condenses in an outdoor heat exchanger (not shown) of the outdoor unit, and evaporates in the indoor heat exchanger (22) of the indoor unit (12). Specifically, in this refrigeration cycle, cooling operation of cooling the air in the indoor heat exchanger (22) is performed.

As shown in FIGS. 1 to 3, the air in the computer (4) flows through the ceiling space (S4) via the air supply ports (5), and is sent to the air conditioner room (S2) via the communication port (7). The air in the air conditioner room (S2) is introduced into the heat exchanger chamber (26) in the casing (20) via the case-side inlet port (not shown) at the top of the casing (20) of the indoor unit (12). The air in the heat exchanger chamber (26) exchanges heat with the refrigerant in the indoor heat exchanger (22), and is cooled. The air cooled in the indoor heat exchanger (22) is sent to the fan chamber (27), and is sucked into the fan (30).

Specifically, in the fan chamber (27), the air around the electric motor (31) is sucked into the first flow path (60*a*) from the first inflow port (66) of the first bell mouth (60). The air rectified in the first flow path (60*a*) is induced to the first fan rotor (40) through the first shroud (43). The air in the first fan rotor (40) is guided radially outward by the plurality of blades (42) of the first fan rotor (40), and is blown out of the casing (20) through the outlet port (24) below the fan case (35).

In the fan chamber (27), the air present across the fan (30) from the electric motor (31) is sucked into the second inflow port (76) of the second bell mouth (70). The air rectified in the second flow path (70*a*) is induced to the second fan rotor (50) through the second shroud (53). The air in the second fan rotor (50) is guided radially outward by the plurality of blades (52) of the second fan rotor (50), and is blown out of the casing (20) through the outlet port (24) below the fan case (35).

The air blown out of the casing (20) flows through the underfloor space (S3), and then is introduced into the computer room (S1) through the air supply ports (5). Thus, the computer room (S1) is cooled.

<Dimensional Relationship of Bell Mouths>

Figure 9:
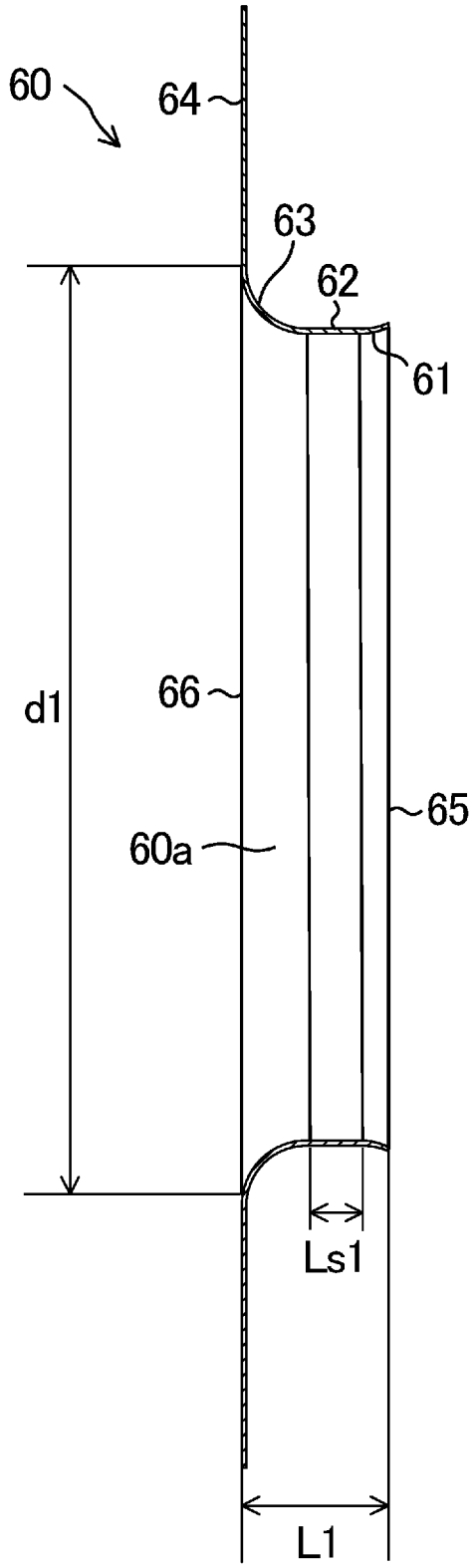
FIG. 9 is a longitudinal sectional view of a first bell mouth according to an embodiment.
Figure 10:
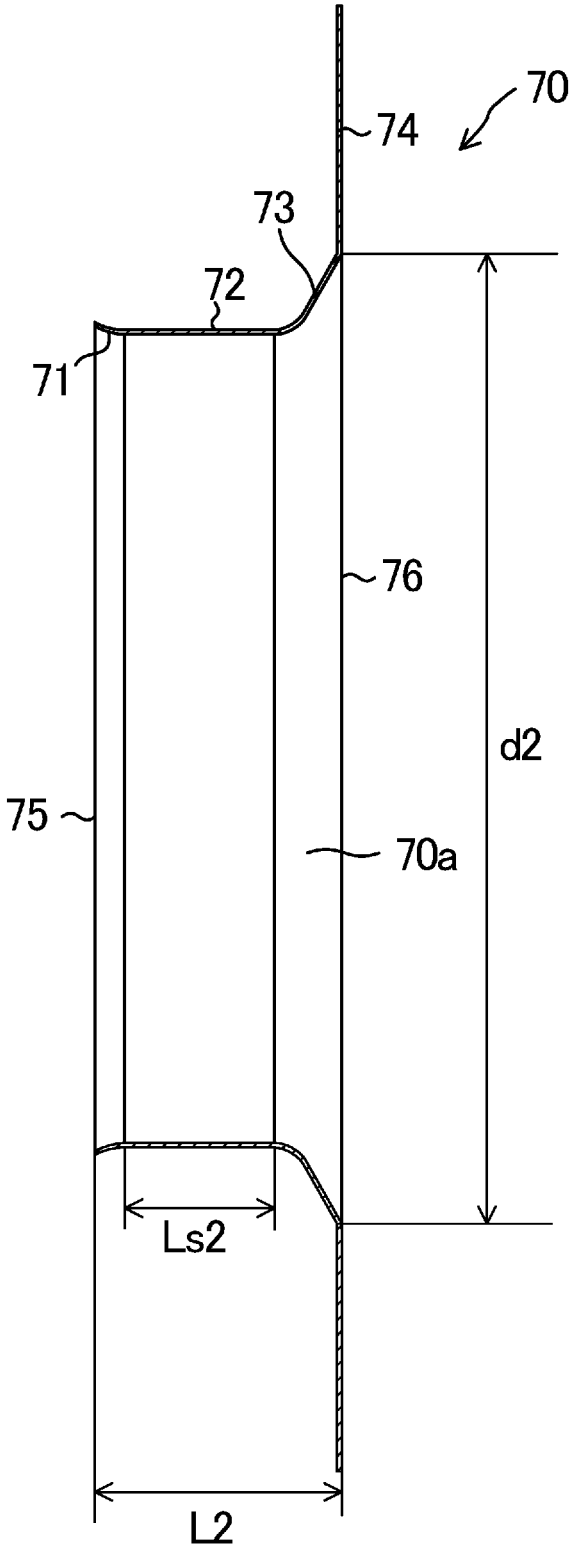
FIG. 10 is a longitudinal sectional view of a second bell mouth according to an embodiment.

As shown in FIGS. 6, 9, and 10, the fan (30) of this embodiment satisfies the following dimensional relationship to improve the fan efficiency.

First, the length L2 (axial length) of the second bell mouth (70) closer to the electric motor (31) is greater than the length L1 (axial length) of the first bell mouth (60) farther from the electric motor (31). The lengths L1 and L2 are the entire axial lengths of the bell mouths (60, 70). For example, the length L1 is set to be about 61 mm, and the length L2 is set to be about 101 mm.

When the length L1 of the first bell mouth (60) is made smaller than the length L2 of the second bell mouth (70), the distance from the electric motor (31) to the first inlet port (44) of the first bell mouth (60) relatively increases. If the distance between the electric motor (31) and the first inlet port (44) is too narrow, the air hardly flows into the first inlet port (44), which may lead to an increase in the air flow resistance. By contrast, reducing the length L1 can reduce such an increase in the air flow resistance, which is presumed to contribute to an increase in the fan efficiency.

On the other hand, making the length L2 of the second bell mouth (70) greater than the length L1 of the first bell mouth (60) increases the rectification effect of the second bell mouth (70). Since the electric motor (31) does not exist around the second inlet port (54) of the second bell mouth (70), the increase in the length L2 does not lead to the increase in the air flow resistance. Hence, this is presumed to contribute to the increase in the fan efficiency.

In this embodiment, the length Ls2 of the second straight portion (72) of the second bell mouth (70) is greater than the length Ls1 of the first straight portion (62) of the first bell mouth (60). The lengths Ls1 and Ls2 of the first and second straight portions (62, 72) of the bell mouths (60, 70) particularly contribute to the rectification of the air. For this reason, increasing the length Ls2 of the second straight portion (72) of the second bell mouth (70) is presumed to particularly contribute to the increase in the fan efficiency. For example, Ls1 is set to be 21.7 mm, and Ls2 is set to be 61.7 mm.

As shown in FIG. 6, in this embodiment, the first bell mouth (60) has a lap length W1, and the second bell mouth (70) has a lap length W2 which is equal to the lap length W1. The lap length W1 is an axial length by which the first bell mouth (60) and the first shroud (43) overlap each other. The lap length W2 is an axial length by which the second bell mouth (70) and the second shroud (53) overlap each other. In the present embodiment, the lap length W1 of the first bell mouth (60) and the lap length W2 of the second bell mouth (70) are equal to each other. The lap lengths W1 and W2 are preferably greater than 5 mm, more preferably 10 mm.

The shaft (33) of the fan (30) may possibly bend downward by the weight of the first and second fan rotors (40, 50). If the shaft (33) is bent, the first bell mouth (60) and the first shroud (43) cannot sufficiently overlap each other over the entire periphery thereof, which may cause the air to leak through the junction between the first bell mouth (60) and the first shroud (43). The same applies to the second bell mouth (70) and the second shroud (53) overlapping each other. Thus, in order to prevent the air leakage caused by the bend of the shaft (33), the lap lengths W1 and W2 are preferably set to be greater than 5 mm. In particular, setting the lap lengths W1 and W2 to be 10 mm can ensure a sufficient overlapping margin for each of the first and second bell mouths (60, 70).

Strictly speaking, providing a sufficient overlapping margin between the second bell mouth (70) and the second shroud (53) is more difficult. This is because the second fan rotor (50) is coupled at a position farther from the electric motor (31) than the first fan rotor (40), and the second bell mouth (70) tilts together with the shaft (33) more easily than the first bell mouth (60). Taking the tilt into consideration, the lap length W2 of the second bell mouth (70) may be made greater than the lap length L1 of the first bell mouth (60). This can sufficiently ensure the overlapping margin between the second bell mouth (70) and the second shroud (53), and can avoid an excessive increase in the overlapping margin between the first bell mouth (60) and the first shroud (43).

In the present embodiment, an inner diameter d2 of the second inlet port (54) of the second bell mouth (70) is greater than an inner diameter d1 of the first inlet port (44) of the first bell mouth (60). A relatively large space is maintained around the second inlet port (54) of the second bell mouth (70). Thus, increasing the inner diameter d2 of the second inlet port (54) allows the second bell mouth (70) to reliably collect the air around it. For example, the inner diameter d1 of the first inlet port (44) is set to be 385.6 mm, and the inner diameter of the second inlet port (54) is set to be 398.2 mm.

As described above, the length L2 of the second bell mouth (70) is greater than the length L1 of the first bell mouth (60). Therefore, inside the fan case (35), a portion between the first and second fan rotors (40, 50) on the axis of the shaft (33) (a middle portion in the axial direction of the coupling member (80)) is displaced toward the electric motor (31) from a middle portion of the fan case (35).

<Evaluation of Fan Efficiency>

FIG. 11 shows the results of a verification test performed on the relationship between the lengths L1 and L2 and lap lengths W1 and W2 of the bell mouths (60, 70) and the fan efficiency. The test was performed to obtain the fan efficiencies of double-suction centrifugal fans which were basically the same in the specification, but were different in the length L1 and lap length W1 of the first bell mouth (60) and the length L2 and lap length W2 of the second bell mouth (70). The improvement in the fan efficiency shown in FIG. 11 is expressed as the increase or decrease relative to the fan efficiency of the double-suction centrifugal fan No. 1.

The double-suction centrifugal fan No. 1 had the length L1 of 61 mm, the length L2 of 61 mm, and the lap lengths W1 and W2 of 5 mm, and the fan efficiency thereof was regarded as the reference of the improvement in the fan efficiency. The fan No. 2 whose lengths L1 and L2 were the same (reference+40 mm) did not show any difference in the fan efficiency from the fan No. 1. On the other hand, the fan No. 3 having the length L1 greater than the length L2 decreased in the fan efficiency by 2%. Conversely, the fans No. 4 to No. 6 in each of which the length L2 was greater than the length L1 increased in the fan efficiency. The fan No. 6 (L1=61 mm, L2=101 mm, W1 and W2=10 mm), which is an optimum embodiment of the present invention, increased in the fan efficiency by 3%.

Advantages of Embodiment

As described above, according to the embodiment described above, the axial length L2 of the second bell mouth (70) farther from the electric motor (31) is made greater than the axial length L1 of the first bell mouth (60) closer to the electric motor (31). This allows the bell mouths (60, 70) to effectively exhibit their function, and can further improve the fan efficiency.

Other Embodiments

The double-suction centrifugal fan (30) of the embodiment has the impellers (40, 50) respectively including the end plates (41, 51). The end plates (41, 51) are fixed to the coupling member (80), which couples the impellers (40, 50) to the shaft (33). However, for example, a single stay may be fixed to the shaft (33), and the plurality of blades (42, 52) may be attached to the front and back sides of the stay. In this case, the stay constitutes a member which is used for both of the first and second impellers (40, 50).

Further, each impeller (40, 50) is not necessarily coupled to the shaft (33) via the coupling member (80), but may be directly coupled or fixed to the shaft (33).

INDUSTRIAL APPLICABILITY

As can be seen, the present invention is useful for a double-suction centrifugal fan.

DESCRIPTION OF REFERENCE CHARACTERS

30 Fan (Double-Suction Centrifugal Fan)
31 Electric Motor
33 Shaft
40 First Impeller
44 First Inlet Port
50 Second Impeller
54 Second Inlet Port
60 First Bell Mouth
70 Second Bell Mouth

The invention claimed is:

1. A double-suction centrifugal fan, comprising:
an electric motor having a shaft;
a first impeller provided with a first inlet port opened toward the electric motor, and coupled to the shaft;
a second impeller provided with a second inlet port opened opposite to the electric motor, and coupled to the shaft at a position farther from the electric motor than the first impeller;
a first bell mouth provided at the first inlet port of the first impeller; and
a second bell mouth provided at the second inlet port of the second impeller, wherein
the first impeller includes a first shroud having the first inlet port formed therein and a portion that overlaps the first bell mouth over an entire periphery,
the first shroud has an inner diameter decreasing toward a side of the first inlet port,
the second impeller includes a second shroud having the second inlet port formed therein and a portion that overlaps the second bell mouth over an entire periphery,
the second shroud has an inner diameter decreasing toward a side of the second inlet port, and
an axial length L2 of the second bell mouth is greater than an axial length L1 of the first bell mouth.

2. The double-suction centrifugal fan of claim 1, wherein
each of the first bell mouth and the second bell mouth has a tubular straight portion extending along an axis thereof, and a length Ls2 of the straight portion of the second bell mouth is greater than a length Ls1 of the straight portion of the first bell mouth.

3. The double-suction centrifugal fan of claim 1, wherein an inner diameter d2 of an air inflow port of the second bell mouth is greater than an inner diameter d1 of an air inflow port of the first bell mouth.

4. The double-suction centrifugal fan of claim 2, wherein an inner diameter d2 of an air inflow port of the second bell mouth is greater than an inner diameter d1 of an air inflow port of the first bell mouth.

* * * * *